United States Patent [19]

Daniels

[11] 4,426,422

[45] Jan. 17, 1984

[54] DISTORTION AND CHEMICALLY RESISTANT HEAT TRANSFER MATERIALS

[75] Inventor: George R. E. Daniels, Boston, Mass.

[73] Assignee: Dennison Manufacturing Company, Framingham, Mass.

[21] Appl. No.: 146,999

[22] Filed: May 6, 1980

Related U.S. Application Data

[63] Continuation of Ser. No. 787,125, Apr. 13, 1977, abandoned, which is a continuation-in-part of Ser. No. 599,431, Jul. 28, 1975, abandoned.

[51] Int. Cl.[3] ..... B41M 3/12; B32B 27/20; C09J 7/02

[52] U.S. Cl. ..... 428/352; 428/40; 428/347; 428/327; 428/424.2; 428/423.7; 428/480; 428/483; 428/488; 428/497; 428/520; 428/914; 428/913

[58] Field of Search ..... 428/424.2, 423.7

[56] References Cited

U.S. PATENT DOCUMENTS 3,516,904 6/1970 Klinker, Jr. ..... 428/40 X
3,927,244 12/1975 Dgura et al. ..... 428/483
3,944,695 3/1976 Kosaka et al. ..... 428/497 X
4,011,358 3/1977 Roelofs ..... 428/480 X

*Primary Examiner*—B. Ives
*Attorney, Agent, or Firm*—George E. Kersey; Arthur B. Moore; Barry D. Josephs

[57] ABSTRACT

Distortion and chemically resistant heat transfer materials formed by a mixture of at least two interspersed polymers. One of the polymers is a film-forming, multi-aromatic ring condensation product, preferably a saturated aromatic, acid-based polyester. This polymer is reinforced by a second polymer which preferably contains bulky ring structures, such as polymerized rosin esters, but may be essentially linear, for example an ethylene-vinyl acetate copolymer. The materials may be used as a protective and brightener coating for labels, which are heat activated to transfer them from a carrier to a final substrate such as the face of a package. The labels thus coated exhibit improved resistance to adverse chemicals such as alcohols, oils and detergents. The materials may also be used to provide distortion and chemically resistant inks, and distortion and chemically resistant adhesives.

5 Claims, 3 Drawing Figures

DISTORTION AND CHEMICALLY RESISTANT HEAT TRANSFER MATERIALS

BACKGROUND OF THE INVENTION

This is a continuation of Ser. No. 787,125, filed Apr. 13, 1977, which is a continuation-in-part, now abandoned, of Ser. No. 599,431 filed July 28, 1975 now abandoned and relates to heat transferable materials, also known as "heat transfers," and more particularly to heat transfer materials which are resistant to distortion and adverse chemical effects.

Heat transfer materials are in substantial commercial use. Such materials are typically used in labels which are transferred from a carrier to a product by heat activation of a release layer. Illustrative heat transfer labels and methods of application are described in U.S. Pat. Nos. 3,616,015, 3,516,904 and 3,516,842.

Heat transfer labels are often applied to containers for alcohols, essential oils, detergents, and adverse chemicals. The labels need to be resistant to chemical effects to avoid loss of label information and, sometimes, the label itself. Chemically resistant labels are also important in coping with filling line spillage and the effects of chemicals in te processing of products. Further, printing inks and adhesives often used for heat transfer labels are soluble in alcohols, heretofore precluding their effective use in resistant labels for alcohol containing products. Another requirement for labels is that they resist scuffing and damage by exposure to water or water vapor.

In U.S. Pat. Nos. 3,516,904 and 3,516,842 an attempt is made to achieve both scruff and chemical resistance by the use of a protective layer of wax-free vinyl acrylic varnish. This acts as a foundation for a design print and prevents migration of the print into the release layer during formation of the label. It also provides adhesion between the release layer and the design print. Although the protective varnish provides some degree of scruff and chemical resistance, it does not prevent distortion of the design print because the latter undergoes a dimensional change during heat transfer.

Accordingly it is an object of the invention to achieve enhanced chemical resistance for heat transfer materials. A related object is to achieve enhanced resistance to alcohols, essential oils, and detergents. A further related object is to avoid loss of label information because of adverse chemical effects.

Another object of the invention is to achieve suitable labeling for products containing alcohol. A related object is to achieve alcohol resistance materials for use in labeling. Another related object is to permit the use of alcohol soluble inks and adhesives in heat transfer labels for alcohol containing products.

A further object of the invention is to realize heat transfer materials which resist distortion during the heat transfer process. A related object is to avoid distortion of heat transfer designs.

A still further object of the invention is to achieve heat transfer materials which resist both distortion during heat transfer and adverse chemical effects afterwards.

SUMMARY OF THE INVENTION

In accomplishing the foregoing and related objects the invention provides a heat transfer material which is a mixture of a first polymeric matrix component that, taken by itself, is distortable at heat transfer temperatures, and a second polymeric reinforcing component that, taken by itself, would produce blocking. The combination of the matrix component with the reinforcing component surprisingly causes less distortion at heat transfer temperatures than would attend the use of the matrix polymeric component alone, and less blockage than would occur if the reinforcing component were used alone.

The term "distortion" is used in the sense that even when the physical integrity of the design is maintained, it departs from its original configuration. Thus straight lines become wavy and printing becomes misshapen.

The term "blockage" is used in referring to a state of tackiness by which there is undesired adhesion when adjacent surfaces come into contact with one another.

In accordance with one aspect of the invention the material is used to provide a distortion and chemically resistant ink.

In accordance with another aspect of the invention the material is used to provide a distortion and chemically resistant adhesion.

In accordance with a further aspect of the invention, the material is used to provide a distortion and chemically resistant heat transfer laminate.

The laminate is desirably formed with the heat transfer material of the invention serving as a base member bearing a design. The base member constitutes a protective and brightening layer for the design, which may have adhesive properties. Otherwise an adhesive layer overlies the design.

In accordance with still another aspect of the invention the laminate is adhesively bonded to a receptive region of a product substrate surface. The combination of the laminate with a product substrate surface is such that the protective layer seals the design from adverse external effects, such as those produced by chemicals, scuffing and abrasion. In addition, the adhesive layer can have essentially the same composition as the protective layer.

In accordance with a further aspect of the invention the heat transfer laminate is adhered to a carrier by a release layer, which is preferably wax.

The reinforcing component desirably constitutes 20 to 50% by weight of the protective layer. The reinforcing component may comprise a rosin ester, an ethylene vinyl acetate copolymer. or an acetate copolymer. The matrix may be a polyester formed by reacting glycols with one or more aromatic acids selected from the class including isophthalic and terephthalic acids, or by a polyester of glycols with phenylindane dicarboxylic acid.

In accordance with a still further aspect of the invention the chemically resistant protective layer is formed by a mixture of a polymeric reinforcing component with a polymeric matrix component that is distortable at wax melting temperatures. The two components combine to produce a composite layer which resists chemicals such as alcohols, essential oils and detergents and is less distortable at heat transfer temperatures than the matrix component taken alone, and exhibits less blockage than would be present if the reinforcing component were used alone.

In accordance with yet another aspect of the invention the chemically resistant protective layer is formed by the combination of a major amount of a polymeric matrix component which is distortable at wax melting temperatures and a minor amount of a polymeric reinforcing component to provide a protective layer which has less distortion under normal conditions of heat transfer and less blockage when the laminate is wound in roll form than would be provided by either polymeric component taken alone.

The chemically resistant protective layer is distortion free under normal conditions of heat transfer and is formed by the homogenous interspersion of two polymers. The first polymer, which is distortable at transfer temperatures can be selected from the class consisting of polyester and polyester-urethane resins, especially aromatic acid-based polyesters, including polyesters made from phenylindane carboxylic acid reacted with a mixture of glycols; and homopolymers, copolymer or interpolymer condensation products of polyester forming reactants, including diols and glycols, and carboxylic, naphthalic sebasic or phthalic acids. The second polymeric component can be selected from the class consisting of rosin esters, vinyl acetate resins and polyesters; especially methyl abietate, methyl hydroabietate, glyceril hydroabietate, ester gum; and other reaction products of polyhydric alcohols, maleic anhydrides or phenol aldehydes with double bonds of rosin acids, including abietic and pimaric acids; ethylene/vinyl acetate; and polyesters made from phenylincane carboxylic acid reacted with a mixture of glycols.

The present invention is based on the discovery that certain polymer mixtures resist distortion during heat transfer and thereafter resist adverse chemical effects.

Such mixed polymer coatings can be described as comprising a first matrix polymer component of bulky molecular structure that is reinforced by a second polymer component which may be bulky or linear in molecular structure.

In the prior art, carbon-carbon bonded linear polymers have been disclosed which are good film forming materials when deposited from solvent solutions in printing. However, the resulting long thin polymer chains exhibit considerable mobility during the heating and become distorted due to shrinkage. Any accompanying design is correspondingly affected.

Polymeric materials of a bulky structural nature, such as those containing a plurality of aromatic rings when modified in accordance with the invention, for example by bulky ring structures or certain classes of linear polymers, have greater dimensional stability than previously afforded for heat transfer application.

Printing and coating grade polymers containing aromatic ring structures in accordance with the invention should have usable solubility in common solvents, transparency and a uniform index of refraction.

The first polymeric component alone is generally not usable alone as a protective layer because it would distort at heat transfer temperatures. Such distortion typically occurs when the heat transfer label is temporarily unsupported by either a carrier or product substrate. The second polymeric component does not serve, of itself, as a protective layer because its film structure could either lead to blocking, i.e. undesired adhesion to other materials such as adjacent turns in a roll or discontinuities. In combination, however, the mixture of the two components produces less distortion and less blockage than either component alone.

DESCRIPTION OF THE DRAWINGS

Other aspects of the invention will become apparent after considering several illustrative embodiments, taken in conjunction with the drawings in which.

DETAILED DESCRIPTION

Figure 1:
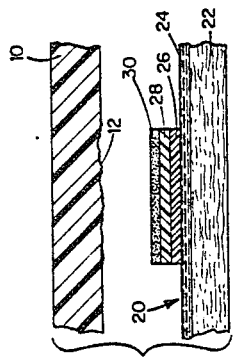
FIG. 1 is a sectional view of a heat transfer laminate in accordance with the invention before application to a product substrate surface.

Referring to the drawings, the invention is illustrated in the context of a heat transfer laminate used to apply a design with a distortion and chemically resistant protective coating to a product substrate surface.

FIG. 1 shows an exploded cutaway and sectioned portion 10 of a product to be labelled, illustrating a wall of a molded thermoplastic container. The product desirably has a surface region 12 that is specially prepared for receiving a heat transfer label.

The labelling takes place using an illustrative medium 20 with a carrier 22, preferably an elongated web of paper or plastic film or air laid plastic fiber sheet, coated with a release layer 24. The release layer, illustratively wax, is further overcoated in discrete areas with the following layers: a protective layer 26 occupying a "first down" layer position; an imprint layer 28 which may comprise printing inks or colorants or a primer sublayer overlaid or impregnated with ink or colorant; and an adhesive "last down" layer 30.

The labelling medium 20 is brought into contact with the surface area 12 of the product 10 and heat is applied to the wax layer 24 to release layers 26, 28, and 30 to surface 12 where they remain through adhesion of layer 30 to the surface 12. A portion of the wax layer 24 is transferred with the other layers 26, 28 and 20.

The invention relates generally to distortion and chemically resistant materials which are used with heat activated transfers to packages and other substrates. The materials are multi-component comprising at least two interspersed polymers. A first one of the polymer components is a film-forming, multi-aromatic ring condensation product, preferably a saturated aromatic, acid-based polyester. A second one of the polymer components reinforces the first component and preferably contains bulky ring structures, such as in polymerized rosin esters, but may be essentially linear such as ethylene/vinyl acetate copolymers. Heat transfer labels coated with the multi-component layer exhibit improved resistance to adverse chemicals such as alcohols, oils and detergents. This protects the heat transfer design, while providing resistance to distortion at heat transfer temperatures, usability in conventional applicational machinery, and compatibility with other layers of the heat transfer lable and substrate carrier.

Figure 2:
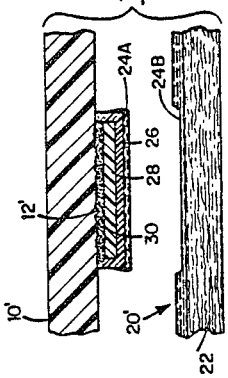
FIG. 2 is a sectional view of a heat transfer laminate in accordance with the invention after application to a product substrate surface.

The resultant coated product 10' and the used medium 20' are shown in FIG. 2. The coated surface region 12' has, in ascending sequence, an adhesive layer 30, an imprint layer 28 and a protective layer 26, overcoated by a waxy layer 24A. The balance of wax from the heated region of transfer medium 20' is indicated at 24B. Preferably the layer 28 overlaps the edges of the imprint layer 28 and the adhesive layer 30 to provide maximum protection to the other materials. However, layers 26, 28, and 30 printed in perfect registration are adequate for many purposes.

It has also been discovered that the composition of protective layer 28 of the present invention can have a wide variety of uses in addition to being a protective layer of a heat transfer laminate. Thus it can replace a conventional last down adhesive layer 30 (FIG. 1) thereby providing a sandwich label (FIG. 2) with a design by conventional inks disposed between protective layers. Chemical resistance is improved by the sandwich construction, particularly in the heat transfer labelling of polyvinyl chloride bottles and plasticized polyvinyl chloride coated glass bottles.

The material of the invention may also be used to provide distortion and chemically resistant adhesives and inks directly.

Figure 3:
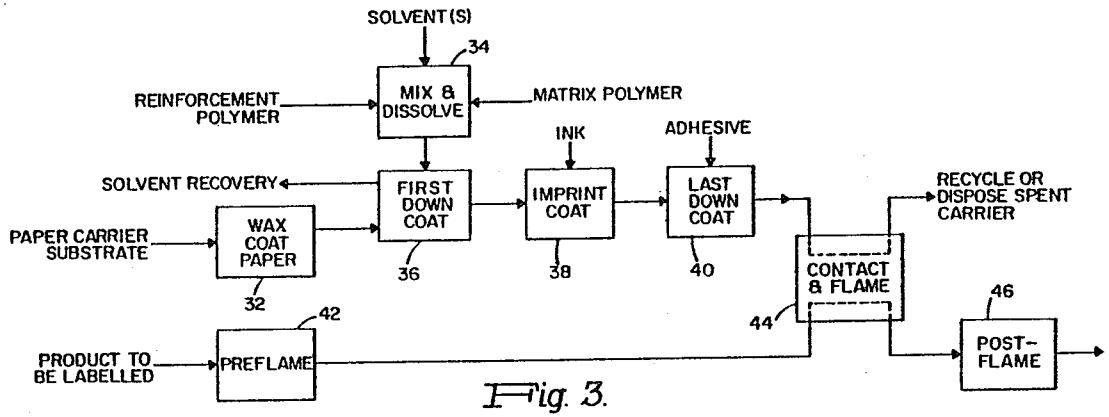
FIG. 3 is a flow chart of an illustrative process for producing a heat transfer laminate in accordance with the invention.

A block diagram for producing and applying the heat transfer laminates of FIGS. 1 and 2 is shown in FIG. 3. Blocks 32 through 40 deal with the preparation of the transfer medium; white blocks 42 through 46 deal with the labelling operation.

The initial step indicated by block 32 is the coating of a paper substrate (22 FIG. 1) with a release material such as wax. The technique for doing this is well known, indicated in U.S. Pat. No. 3,616,015. Block 34 indicates the formulation of the mixed polymer protective layer to be applied through any conventional coating process, e.g. emulsion, hot melt or, preferably, solvent release. Individual or common solvents for the reinforcing and matrix polymers are mixed with other modifiers, fillers, plasticizers or colorants as desired.

The protective layer is applied as indicated by block 36 over the wax layer and the solvent is evaporated and processed through conventional solvent recovery equipment. Block 38 indicates a conventional printing step using a letterpress, rotogravure, casting, doctor blade or any other suitable technique. The last down coating step indicated by blade 40 may be a repeat of step 36, indicated above, or the application of nitrocellulose base lacquer using materials and methods described in Vol. III, Chapter 18 of Mattiello, "Protective and Decorative Coatings," (John Wiley & Sons, New York 1943). Polyamide nitrocellulose is the lacquer of choice for adhesion to polyethylene bottles, while polyisobutyl methacrylate is the lacquer of choice for adhesion to polyvinyl chloride bottles.

The thicknesses of the first down and last down layers are illustratively 0.1–0.3 mils and the print layers may be 0.1–0.5 mils thick. The wax layer is desirably 0.25–0.35 mils thick in accordance with conventional practice.

The product substrate may be prepared for labelling by preflaming as indicated in block 42 or by abrasion or corona discharge. Block 44 indicates the contacting and heating, preferably flame heating, of the two substrates using equipment described for instance in U.S. Pat. Nos. 2,981,432, 3,064,714 and 3,616,016. The substrates are pulled apart while hot, and the transfer is made. The spent carrier substrate may be rewaxed and otherwise reprocessed, and the labelled product substrate may be postflamed (block 46) to clarify its wax carryover topping as taught in U.S. Pat. No. 3,616,015 to complete the labelling process.

The bulky polymer reinforcement, matrix or first component of the layer 28 preferably comprises polyester and polyester-urethane resins soluble in common gravure solvents. Preferred polyesters are aromatic acid-based polyesters such as Goodyear's Vitel brand PE-200 and PE-222 polyesters—yellow, amorphous granules of Acid Number 1 to 10 (preferably 104), 75–80 D scale Shore Durometer hardness, 1.25 specific gravity and 150°–170° C. ring and ball softening point, or the USM Chemical Co. Bostik model 7976 and 7977 brand polyesters made from phenylindane carboxylic acid reacted with a mixture of glycols as more particularly set forth in U.S. Pat. No. 2,830,966 to Petropoulos dated Apr. 15, 1958.

Homopolymer, copolymer or interpolymer condensation product of (a) diols, glycols and other polyester forming reactants and (b) carboxylic, naphthalic, sebacic or phthalic acids such as those described in British Pat. Nos. 766,290, 769,220, 804753, 819,640, 877539, 1,043,313, and 1,073,640, including the lower alkyl esters of the reactants (up to 4 carbon atoms), may also be used for purposes of the present invention.

Rosin esters usable as the reinforcing or second polymer component of the mixture are formed by reaction of polyhydric alcohols generally, maleic anhydride or phenol aldehyde with double bonds of rosin acids (abietic acids and pimaric acids) and include methyl abietate, methyl hydroabietate, glyceryl hydroabietate, ester gum. Pentaerythritol used in place of glycerine to form rosin esters is reported in U.S. Pat. No,. 1,920,265 (1931) to Bent et al. The Hercules Chemical Co., Neolyn and Pentalyn brand series are particularly suitable for purposes of the present invention. Rosins described in U.S. Pat. No. 2,047,004 may also be used. The rosins should have a ring and ball softening point of 50° to 250° C.

Vinyl resins usable as the second polymer component may include ethylene/vinyl acetate. DuPont's Elvax series is particularly suitable for purposes of the present invention. Elvax-40 is a 39–42% vinyl acetate, medium to low viscosity (0.70 cP at 30° C. and 0.25 g 1100 ml toluene) resin which is soluble in organic solvents and has a bulk density of 30 lb/ft$^3$. (ASTM D-1895/B), a ring and ball softening point of 200° C. (and a melt index of 45–65 grams per 10 minutes (ASTM-D 1238 modified). Elvax-150 is a 32–34% vinyl acetate resin which is also usable in solvent applied coatings and has a viscosity of 0.78, bulk density of 33, softening point of 240° C. and a melt index of 22–28.

In some instances a nominal polyester component, being itself a copolyester will comprise both reinforcing as well as matrix components for purposes of the present invention. Bostik 7977 polyester is also usable in selected applications. However, it is preferred to supplement the reinforcement inherent therein with one of the reinforcements described above, e.g. rosin esters.

The polymer matrix and polymer reinforcement should both be soluble in the same or miscible solvents. They should have a refractive index of about 1.5. The reinforcement polymer should preferably comprise 20 to 50 weight percent of the reinforcement-matrix mixture. These proportions are adjusted in relation to component selection to prevent blocking by the matrix and to limit distortion of the protective layer in the course of heat transfer or during any preheating or postheating steps that are incident to the heat transfer.

The practice of the invention is further illustrated by the following non-limiting Examples.

EXAMPLE 1

A distortion and chemically resistant heat transfer material was formed by mixing a polymeric matrix component constituting eighty parts by weight of Vitel PE-200, Goodyear polyester, with a polymeric reinforcing component constituting twenty parts by weight of Pentalyn 802A, Hercules phenolic modified pentaerythritol ester of rosin.

The heat transfer material was dissolved in methylethylketone solvent, reduced to gravure printing viscosity to form a lacquer, and coated on a wax release paper prepared in accordance with U.S. Pat. No. 3,616,015.

A design was then printed over the lacquer layer using polyamide-nitrocellulose inks. An adhesive layer comprising a solution of a thermoplastic polyamide nitrocellulose resin mixture was then overprinted on the design.

The resulting heat transfer laminate was brought into contact with a polyethylene bottle whose surface had been flame treated to render it receptive to adhesives. The desired heat transfer was accomplished using conventional applicational techniques, including a post-flaming step.

Adhesion of the label to the bottle was found to be excellent and exposure to a variety of alcohol based proprietary commercial products showed little or no effect on the label. Conventional labels unprotected by the protective layer showed rapid deterioration and eventual destruction on similar exposure.

EXAMPLE 2

Example 1 was repeated except that the matrix component of the heat transfer material consisted of 80 parts Vitel PE-200 and the reinforcing component was 26.7 parts Neolyn 23-75T, Hercules polymerized elastomeric rosin ester with 75% solids in toluene. The material was then dissolved in a methylethylketone solvent. The results were similar to Example 1.

EXAMPLE 3

Example 2 was repeated except that the material was dissolved in a solvent blend of 40 parts n-butyl acetate, 40 parts toluene and 20 parts methyl (butyl) ketone. The results were similar to Example 1.

EXAMPLE 4

Example 3 was repeated except that the matrix component consisted of 87 parts of Vitel PE-200 and the reinforcing component was 13 parts Elvax 40, duPont ethylene/vinyl acetate copolymer. The results were similar to Example 1.

EXAMPLE 5

Example 2 was repeated except that the reinforced polymeric matrix was also applied as a last down overprint and as a replacement for the thermoplastic polyamide/nitrocellulose resin mixture. The resulting label transferred to a polyvinyl chloride bottle was found to have excellent adhesion and excellent resistance to alcohol-based products.

EXAMPLE 6

Example 1 was repeated except that the polyester matrix component was polyester made from phenylindane dicarboxylic acid (U.S. Pat. No. 2,830,966), polyester #7977, USM Chemical Co., and a mixture of glycols. The results were the same as in Example 1.

EXAMPLE 7

The distortion and chemically resistant mixture of Example 1 was used to form an adhesive which was then used in heat transfer labelling. The result was adhesion with excellent resistance to adverse chemicals, as well as resistance to distortion during the heat transfer operation.

EXAMPLE 8

The distortion and chemically resistant mixture of Example 2 was used to form an adhesive which was then used in heat transfer labelling. The result was adhesion with excellent resistance to adverse chemicals, as well as resistance to distortion during the heat transfer operation.

EXAMPLE 9

The distortion and chemically resistant mixture of Example 6 was used to form an adhesive which was then used in heat transfer labelling. The result was adhesion with excellent resistance to adverse chemicals, as well as resistance to distortion during the heat transfer operation.

EXAMPLE 10

The distortion and chemically resistant mixture of Example 1 was used to form an ink which was then used in heat transfer labelling. The result was an ink with excellent resistance to adverse chemicals, as well as resistance to distortion during the heat transfer operation.

EXAMPLE 11

The distortion and chemical resistant mixture of Example 2 was used to form an ink which was then used in heat transfer labelling. The result was an ink with excellent resistance to adverse chemicals, as well as resistance to distortion during the heat transfer operation.

EXAMPLE 12

The distortion and chemical resistant mixture of Example 6 was used to form an ink which was then used in heat transfer labelling. The result was an ink with excellent resistance to adverse chemicals, as well as resistance to distortion during the heat transfer operation.

What is claimed is:

1. A heat transfer label laminate for applying a label to a product substrate comprising a layer of heat activatable adhesive, a print layer adjacent the adhesive layer comprising a polymeric layer in the form of a print pattern, and a protective layer adjacent the print layer wherein the protective layer comprises a mixture of at least two polymeric components, one of which is a reinforcement and the other of which is a matrix, the reinforcement component comprising a rosin ester or an ethylene vinyl acetate copolymer and the matrix comprising a polyester of a glycol and phenolindane carboxylic acid or a copolyester of isophthalic acid and teraphthalic acid.

2. A heat transfer laminate in accordance with claim 1 further comprising a carrier substrate in combination with the laminate and adhered thereto by a release layer.

3. A laminate product in accordance with claim 1, wherein the adhesive layer has essentially the same composition as said protective layer.

4. A laminate product in accordance with claim 1, wherein it further comprises a wax layer adjacent the protective layer, and a web form substrate supporting the wax layer, the protective layer, the print layer and the adhesive layer.

5. A laminate product in accordance with claim 1, wherein said protective layer comprises said reinforcement as 20 to 50 weight percent thereof.

* * * * *